US006609904B2

(12) United States Patent
Chen

(10) Patent No.: US 6,609,904 B2
(45) Date of Patent: Aug. 26, 2003

(54) GAS FURNACE CONTROL ARRANGEMENT

(76) Inventor: Wen-Chou Chen, No. 34, Lane 87, Fu I Street, Chi Tu, Keelung (TW), 206

( * ) Notice: Subject to any disclaimer, the term of this patent is extended or adjusted under 35 U.S.C. 154(b) by 0 days.

(21) Appl. No.: 09/753,730

(22) Filed: Jan. 3, 2001

(65) Prior Publication Data

US 2002/0086254 A1 Jul. 4, 2002

(51) Int. Cl.[7] ..... F23N 5/00

(52) U.S. Cl. ..... 431/71; 431/281; 126/116 A; 236/1 EA; 236/10

(58) Field of Search ..... 126/116 A; 431/71, 431/281, 278; 137/599.01, 599.06, 599.07, 110; 236/1 E, 1 EA, 10, 11

(56) References Cited

U.S. PATENT DOCUMENTS 3,905,394 A * 9/1975 Jerde ..... 137/599.04
4,425,930 A * 1/1984 Kruto ..... 137/599.01
4,602,610 A * 7/1986 McGinnis ..... 126/116 A
5,117,856 A * 6/1992 Kim et al. ..... 137/110
5,601,071 A * 2/1997 Carr et al. ..... 126/116 A
5,938,425 A * 8/1999 Damrath et al. ..... 126/39 E

* cited by examiner

*Primary Examiner*—Henry Bennett
*Assistant Examiner*—James G. Barrow

(57) ABSTRACT

A gas furnace control arrangement includes a control unit control unit and an operating unit adapted to control the control unit, the control unit having a valve seat holding a set of solenoid valves, the solenoid valves including a main valve for fuel gas input control, a mother flame valve adapted to control a gas passage from the valve seat to a mother flame nozzle, a high flow rate valve and a medium flow rate valve and a low flow rate valve adapted to control a respective gas passage from the valve seat to a main flame nozzle, the operating unit including a power switch adapted to switch on/off an electronic igniter and to close/open the main valve and the mother flame valve, a strong flame switch adapted to close/open the high flow rate valve, a medium flame switch adapted to close/open the medium flow rate valve, and a weak flame switch linked to the strong flame and the medium flame switch and adapted to close/open the low flow rate valve.

13 Claims, 11 Drawing Sheets

GAS FURNACE CONTROL ARRANGEMENT

BACKGROUND OF THE INVENTION

The present invention relates to a gas furnace and, more specifically, to a gas furnace control arrangement, which enables the user to operate the gas furnace at a far place from the furnace body.

Regular gas furnaces commonly use a piezoelectric ignition device to control ignition and furnace flame regulation. Because the ignition device is mounted on the furnace body, the user must walk to the furnace body when operating the ignition device. Because the furnace body of a gas furnace is generally installed in the floor, the user must bend the body or sit on the heels when operating the ignition device. This design is inconvenient to a disabled or old person. Further, when operating the piezoelectric ignition device, the cock must be held in the depressed status for several seconds when turned to the ignition position. Early release of the cock may cause an ignition failure. This operation takes much time and effort.

SUMMARY OF THE INVENTION

The present invention has been accomplished to provide a gas furnace control arrangement, which eliminates the aforesaid problems.

It is one object of the present invention to provide a gas furnace control arrangement, which comprises a control unit installed in the furnace body, and an operating unit installed any desired location far from the furnace body and connected to the electronic igniter of the gas furnace and the control unit by conductors for enabling the user to operate the gas furnace without approaching the furnace body.

It is another object of the present invention to provide a gas furnace control arrangement, which enables the user to ignite the electronic igniter of the furnace and to regulate the volume of the furnace flame by means of switching on/off a set of switches just like operating an indoor lamp switch or the remote controller of an electric home appliance.

According to one embodiment of the present invention, the gas furnace control arrangement comprises a control unit and an operating unit. The control unit is installed in the furnace body of a gas furnace having an electronic igniter and a mother flame nozzle and a main flame nozzle, and connected to the electronic igniter by conductor means. The control unit comprises a valve seat supported on the furnace body, and a set of solenoid valves mounted in the valve seat. The solenoid valves include a main valve adapted to control a gas passage from an external fuel gas source to the valve seat, a mother flame valve adapted to control a gas passage from the valve seat to the mother flame nozzle, a high flow rate valve adapted to control a big gas passage from the valve seat to the main flame nozzle, a medium flow rate valve adapted to control a medium gas passage from the valve seat to the main flame nozzle, and a low flow rate valve adapted to control a small gas passage from the valve seat to the main flame nozzle. The operating unit is provided outside the furnace body and respectively connected to the control unit and the electronic igniter by respective conductor means, comprising a power switch adapted to switch on/off the electronic igniter to discharge sparks for burning fuel gas at the mother flame nozzle and to close/open the main valve and the mother flame valve, a strong flame switch adapted to close/open the high flow rate valve, a medium flame switch linked to the strong flame switch and adapted to close/open the medium flow rate valve, and a weak flame switch linked to the strong flame switch and the medium flame switch and adapted to close/open the low flow rate valve.

Other objects, advantages, and novel features of the invention will become more apparent from the following detailed description when take in conjunction with the accompanying drawings.

DETAILED DESCRIPTION OF THE PREFERRED EMBODIMENT

Figure 1:
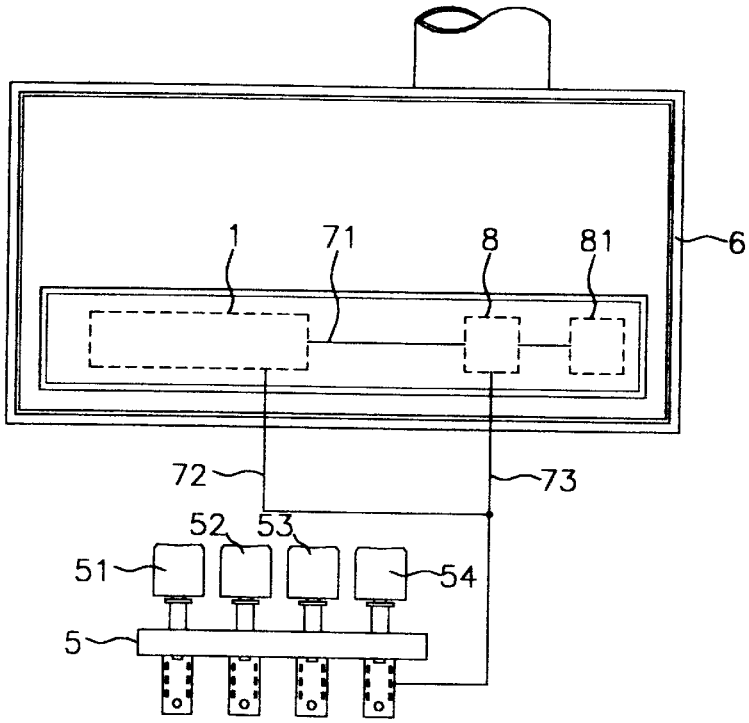
FIG. 1 is a schematic drawing showing a wired application example of the present invention.

Referring to FIG. 1, a gas furnace control arrangement in accordance with the present invention is generally comprised of a control unit 1, and an operating unit 5. The control unit 1 is provided in the furnace body 6 and electrically connected to the electronic igniter 8 in the furnace body 6 by a conductor 71. The operating unit 5 is provided outside the furnace body 6, for example, mounted on the wall, and respectively connected to the control unit 1 and the electronic igniter 8 by respective conductors 72 and 73. The operating unit 1 provides a set of switches 51~54 through which the user controls the ignition of the electronic igniter 8 and the volume of the furnace flame.

Figure 3:
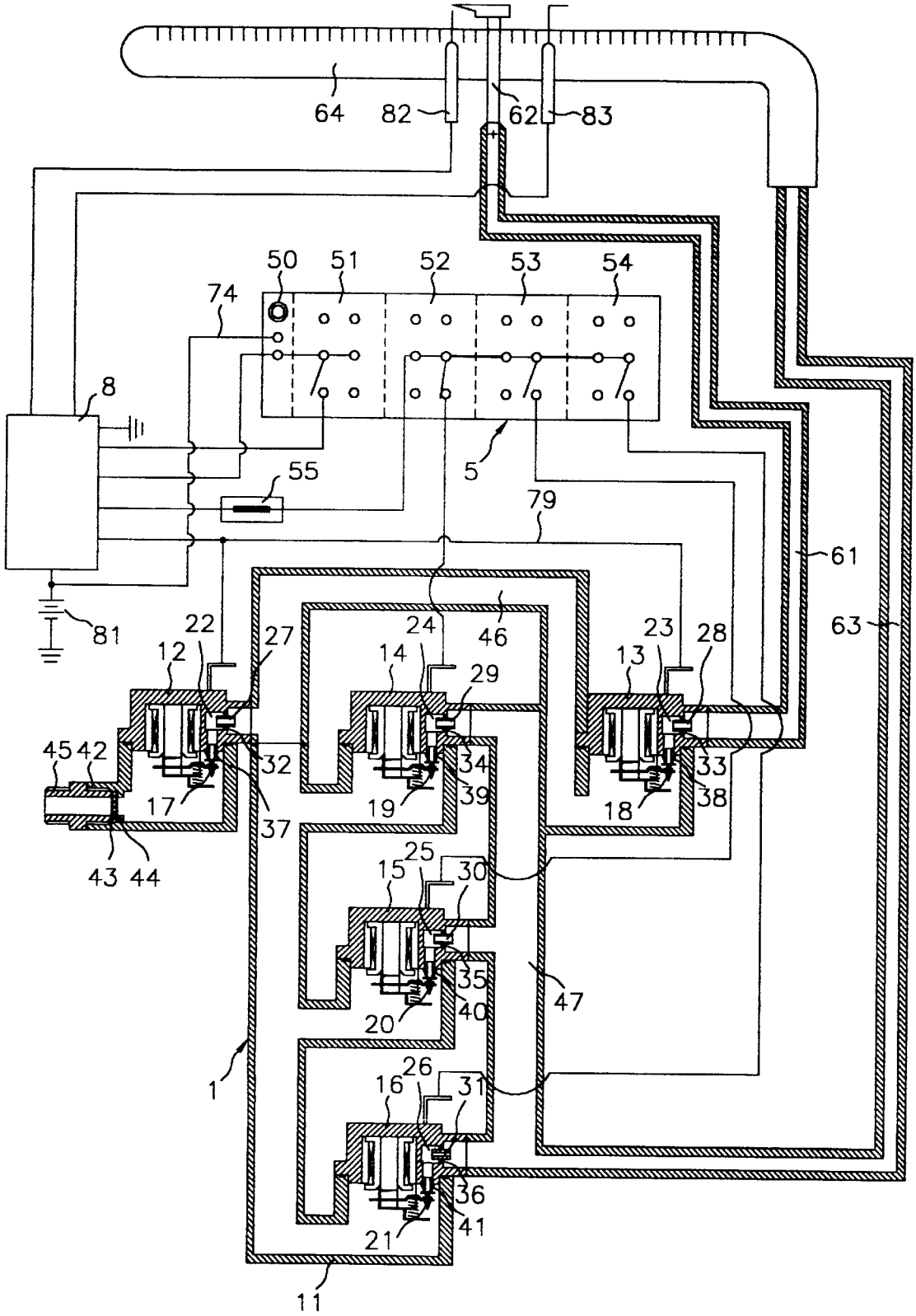
FIG. 3 illustrates the structure of a gas furnace control arrangement according to a first embodiment of the present invention.

Referring to FIG. 3, the control unit 1 comprises a valve seat 11 supported on the furnace body 6 to hold a main valve 12, mother flame valve 13, a high flow rate valve 14, a medium flow rate valve 15, and a low flow rate valve 16. The valve seat 11 comprises an inlet 42 mounted with a wire gauze filter 43. The wire gauze filter 43 is supported on a radial flange 44 inside the inlet 42 and secured in place by a pipe connector 45. The main valve 12 controls the gas passage to the valve seat 11. The mother flame valve 13 controls the gas passage to the mother flame nozzle, referenced by 62. The high flow rate valve 14 controls the gas passage to the main flame nozzle, referenced by 64, for enabling a high volume of fuel gas to be discharged out of the main flame nozzle 64 for producing a strong furnace flame. The medium flow rate valve 15 controls the gas passage to the main flame nozzle 64, for enabling a medium volume of fuel gas to be discharged out of the main flame nozzle 64 for producing a medium furnace flame. The low flow rate valve 16 controls the gas passage to the main flame nozzle 64, for enabling a low volume of fuel gas to be discharged out of the main flame nozzle 64 for producing a weak furnace flame. The valves 12~16 are solenoid valves of normally closed type, i.e., when electrically disconnected, the respective valve cocks 17~21 are closed to stop the gas passage; when electrically connected, the valve cocks 17~21 are opened to let fuel gas pass. Because the solenoid valves 12~16 are made subject to the known techniques, no further detailed description is necessary.

In order to facilitate fabrication, the solenoid valves 12~16 are identical, and installed with a respective gas tube for controlling the flow rate of fuel gas. For example, gas tubes 27, 28 and 29 of inner diameter 5 mm are respectively mounted in the outlets 22, 23 and 24 of the main valve 12, the mother flame valve 13 and the high flow rate valve 14; a gas tube 30 of inner diameter 3.5 mm is installed in the outlet 25 of the medium flow rate valve 15; a gas tube 31 of inner diameter 2.0 mm is installed in the outlet 26 of the low flow rate valve 16. By means of providing different diameters of gas tubes 27~31 in the valves 12~26, different flow rates of fuel gas are provided through the valves 12~26. By means of the aforesaid arrangement, it is necessary to manufacture solenoid valves of one size only. O-rings 32~36 are respectively mounted on the gas tubes 27~31 and pressed on the inside wall of the respective outlets 22~26 to seal the gap and to prevent gas leakage. Changing the inner diameter of the gas tubes 37~41 in the inlets of the solenoid valves 12~16 achieves the same gas flow rate control effect.

Referring to FIG. 3, the operating unit 5 comprises an indicator light 50, a power switch 51, a strong flame switch 52, a medium flame switch 53, a weak flame switch 54, and a control circuit (not shown). The control circuit controls on/off status of the indicator light 50, and is connected to power supply by a conductor 74. When power low of the battery 81, the control circuit turns on the indicator light 50, informing the user to replace the battery 81. The power switch 51 is adapted to switch on/off the electronic igniter 8. The strong flame switch 52 controls on/off status of the high flow rate valve 14. The medium flame switch 53 controls on/off status of the medium flow rate valve 15. The weak flame switch 54 controls on/off status of the low flow rate valve 16. Further, the strong flame switch 52, the medium flame switch 53 and the weak flame switch 54 are linked to one another such that when the strong flame switch 52 is switched to "On" position, the medium flame switch 53 and the weak flame switch 54 are automatically switched to "Off" position; when the medium flame switch medium flame switch 53 is switched to "On" position, the strong flame switch 52 and the weak flame switch 54 are automatically switched to "Off" position; when the weak flame switch 54 is switched to "On" position, the strong flame switch 52 and the medium flame switch 53 are automatically switched to "Off" position. Because this switch linking technique is of the known art, it is not described herein in detail.

Figure 4:
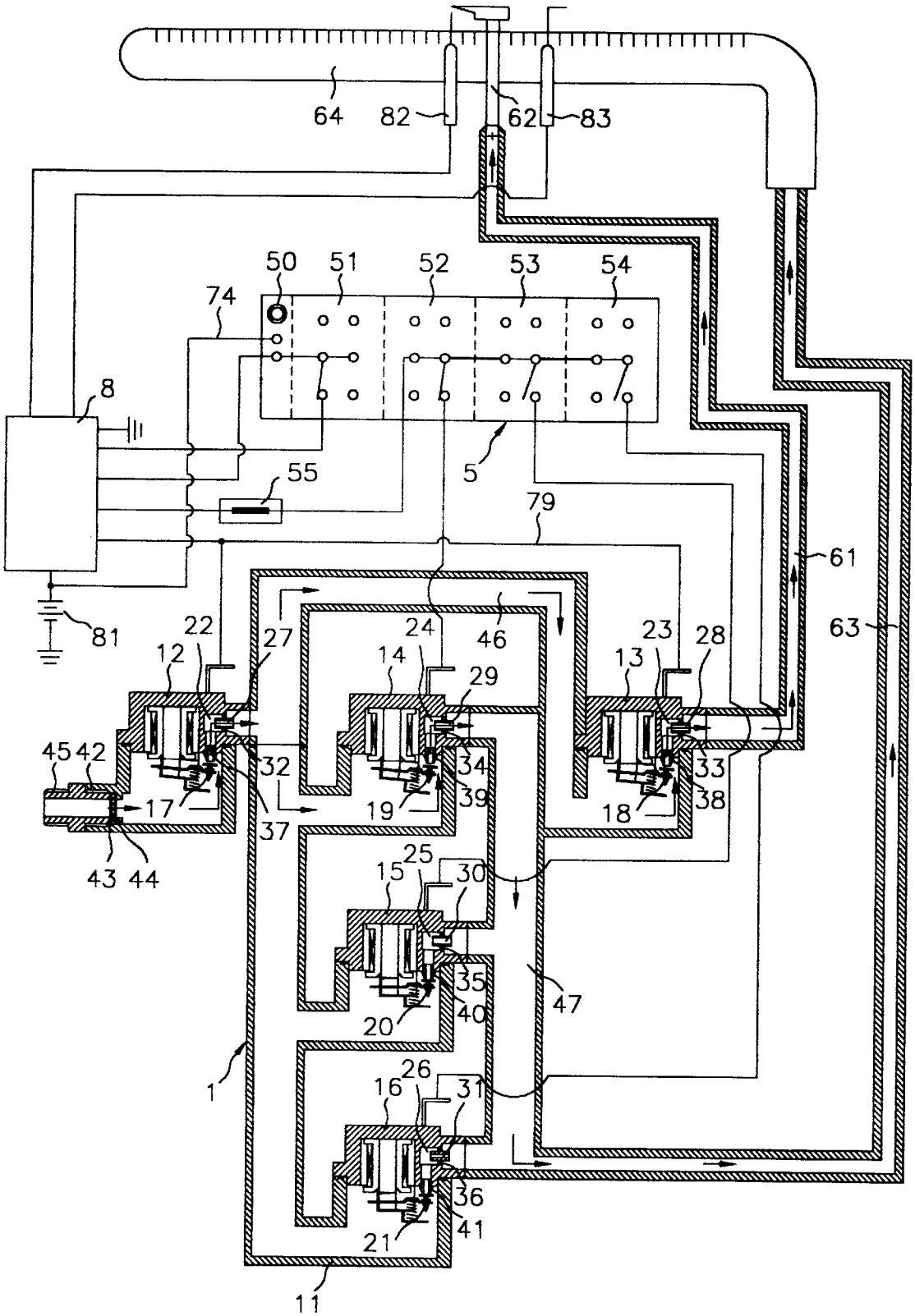
FIG. 4 shows a status of the first embodiment of the present invention where the power switch and the strong flame switch switched on, the main valve and the mother flame valve and the high flow rate valve opened.

The control of the gas furnace is outlined hereinafter with reference to FIG. 4. When switched on the power switch 51, electricity is connected to the electronic igniter 8, thereby causing the main valve 12 and the mother flame valve 13 to be turned to the open position (i.e., the valve cocks 17 and 18 are opened), allowing fuel gas to pass from the inlet 42 through the main valve 12 to the valve seat 11, and then to pass through the fuel gas passage 46 to the mother flame valve 13, and to pass through the gas pipe 61 to the mother flame nozzle 62, and at the same time sparks are discharged through the ignition plug 82 to burn the flow of fuel gas discharged through the mother flame nozzle 62. After burning of the flow of fuel gas discharged through the mother flame nozzle 62, the sensor, referenced by 83, detects the burning signal and gives an output signal to the electronic igniter 8, causing it to stop from discharging electricity through the ignition plug 82 and to connect electricity to the strong flame switch 52, the medium flame switch 53 and the weak flame switch 54. If the user presses one of the switches 52~54 (for example, the strong flame switch 52) at this time, the high flow rate valve 14 is energized to open the cock 19, for enabling fuel gas to pass through the high flow rate valve 14 along the gas passage 47 and the main gas pipe 63 to the main flame nozzle 64 for burning by the mother flame at the mother flame nozzle 62, so as to further provide hot-air to warm the house. Because the maximum volume of fuel gas is discharged through the high flow rate valve 14, the maximum furnace flame is provided.

Figure 5:
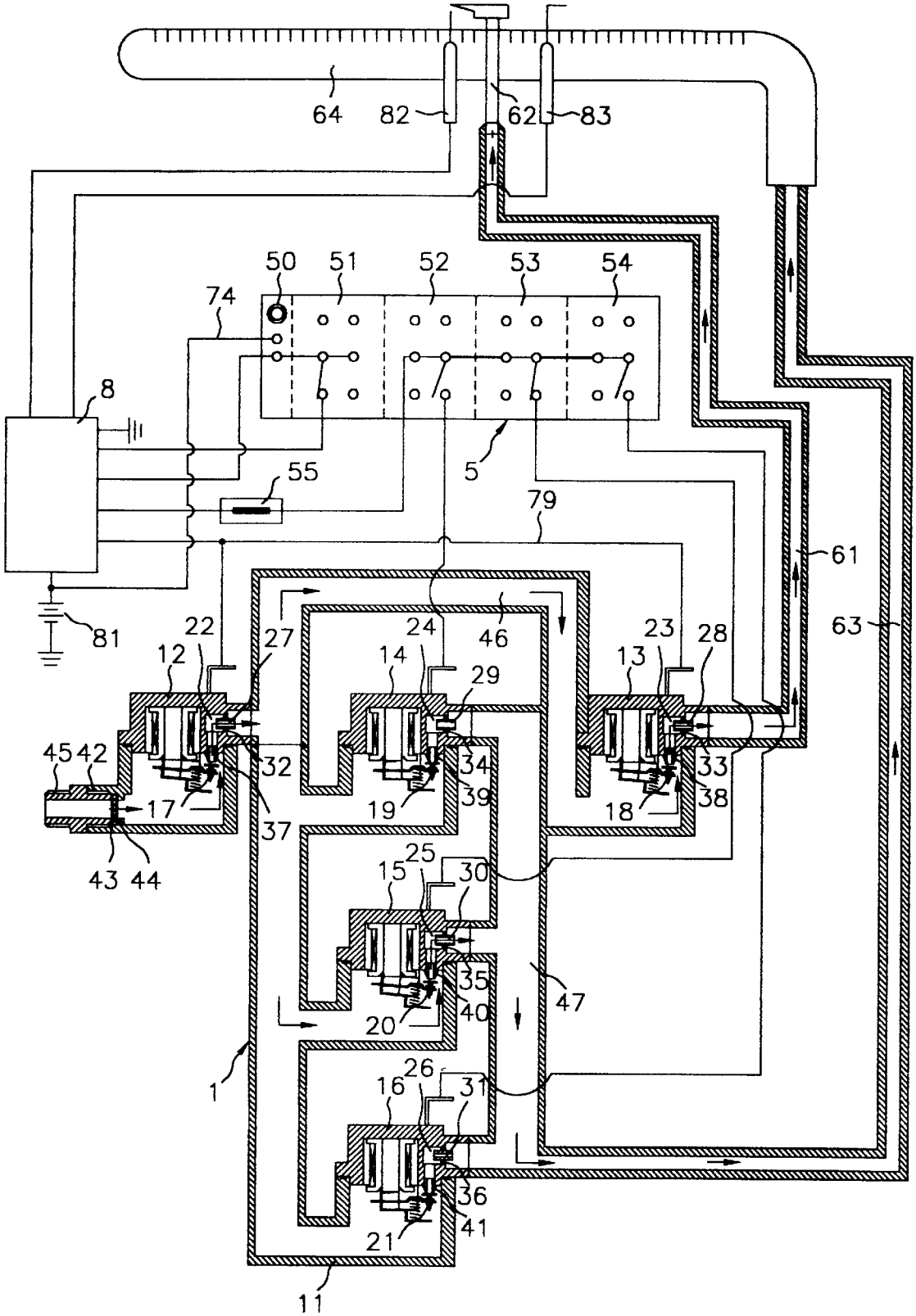
FIG. 5 shows another status of the first embodiment of the present invention where the power switch and the medium flame switch switched on, the main valve and the mother flame valve and the medium flow rate valve opened.

If the temperature of the house is excessively high, the user can switch on the medium flame switch 53, as shown in FIG. 5. When switched on the medium flame switch 53, the medium flow rate valve 15 is electrically connected to open the cock 20, and at the same time the strong flame switch 52 and the weak flame switch 54 are automatically switched off to close the high flow rate valve 14 and the low flow rate valve 16, for enabling fuel gas to pass through the medium flow rate valve 15 along the gas passage 47 and the main gas pipe 63 to the main flame nozzle 64 for burning. At this time, a medium furnace flame is provided, and the mother flame still exists.

Figure 6:
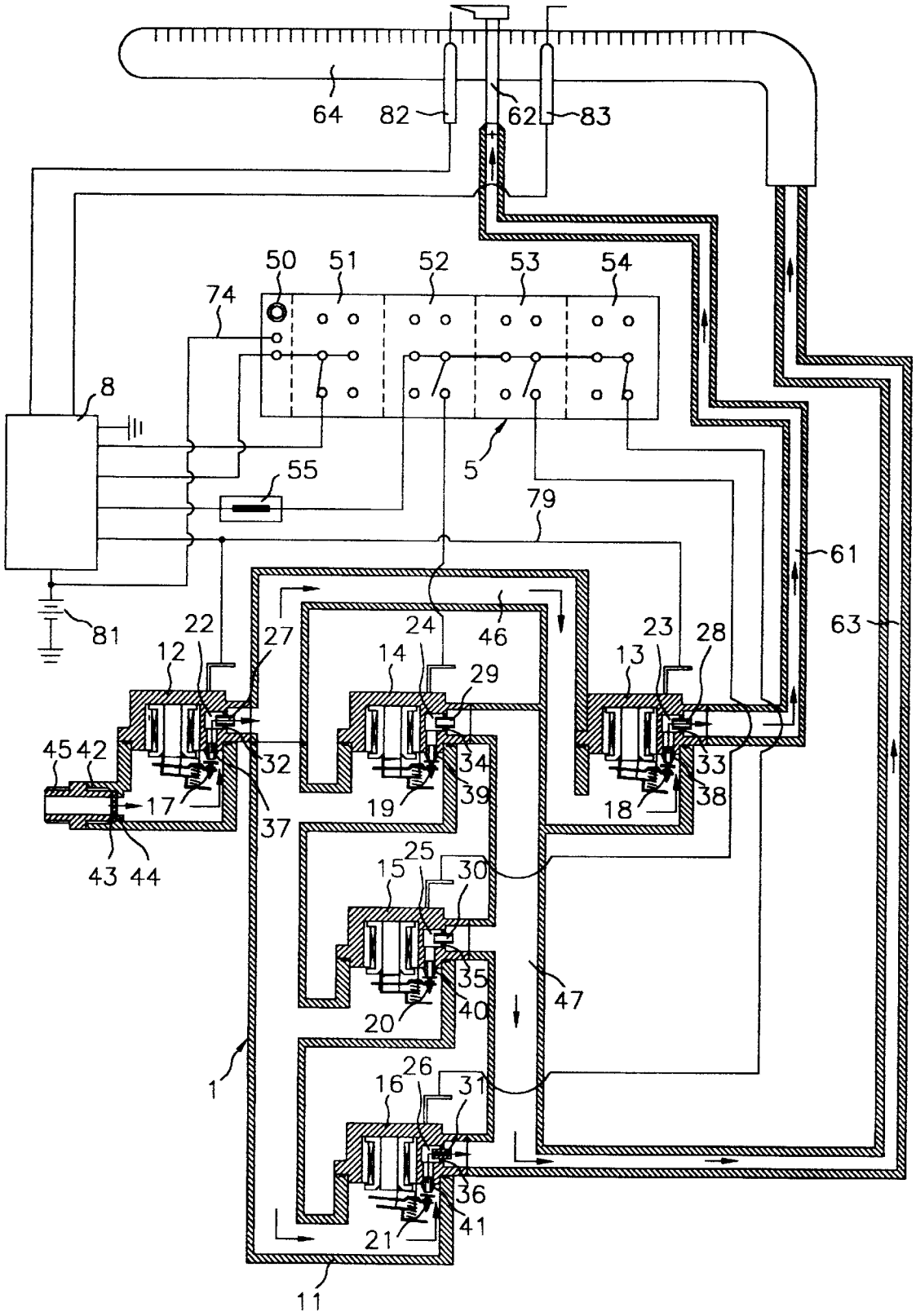
FIG. 6 shows another status of the first embodiment of the present invention where the power switch and the weak flame switch switched on, the main valve and the other flame valve and the low flow rate valve opened.
Figure 7:
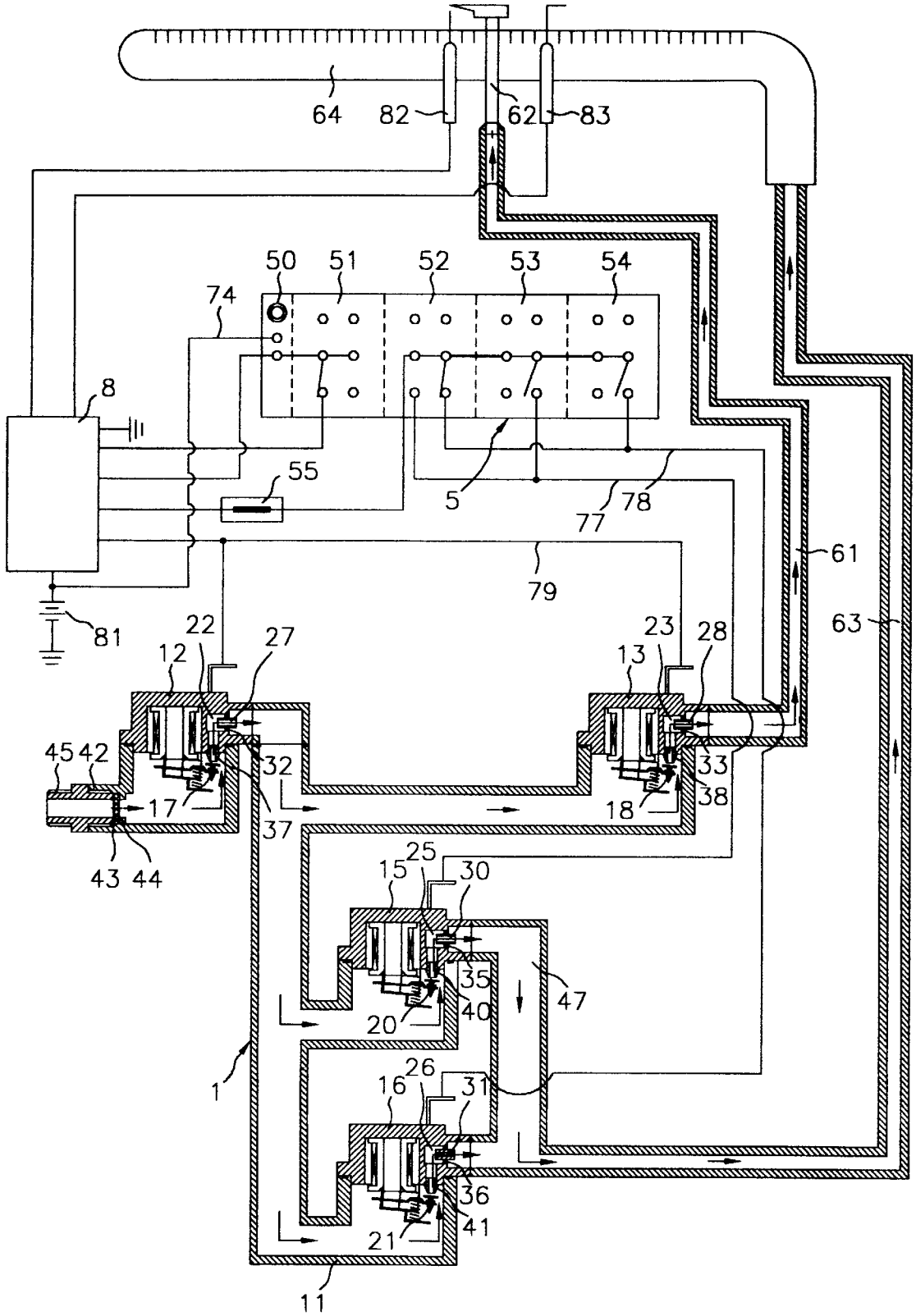
FIG. 7 illustrates the structure of a gas furnace control arrangement according to a second embodiment of the present invention.

When adjusting the furnace flame to the minimum status, as shown in FIG. 6, the weak flame switch 54 is switched on to open the cock 21 of the low flow rate valve 16, and at the same time to automatically switch off the strong flame switch 52 and the medium flame switch 53, for enabling fuel gas to pass through the low flow rate valve 16 along the gas passage 47 and the main gas pipe 63 to the main flame nozzle 64 for burning. At this time, a weak furnace flame is provided, and the mother flame still exists.

As indicated above, when switched on the power switch 51 to ignite a fire, the strong flame switch 52, the medium flame switch 53, or the weak flame switch 54 is switched to discharge fuel gas through the main flame nozzle 64 at the desired flow rate for burning by the mother flame at the mother flame nozzle 62. By means of selectively switch on one of the flame switches 51, 52 and 53, the volume of the furnace flame is controlled. This flame volume control is as simple as the operation of an indoor lamp switch, and much convenient than the conventional piezoelectric ignition systems.

Figure 2:
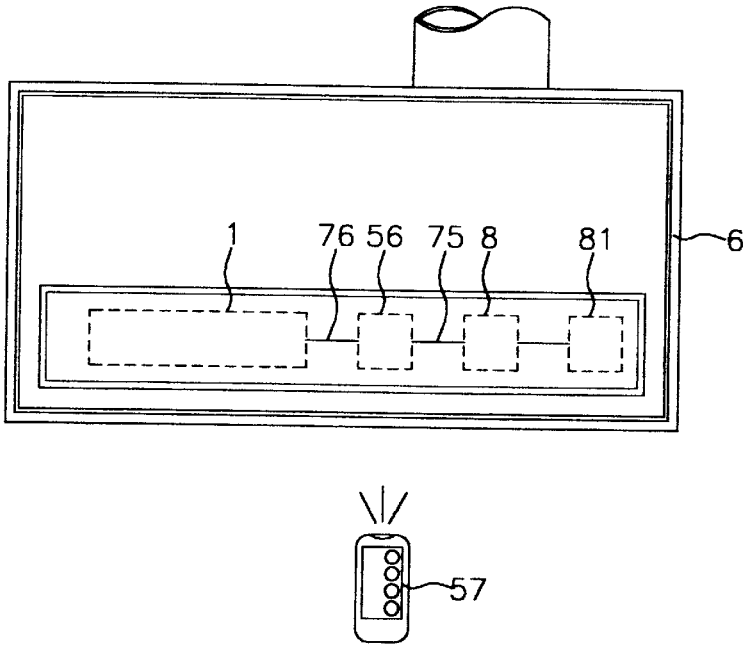
FIG. 2 is a schematic drawing showing a wireless application example of the present invention.

In the annexed drawings, the locations of the solenoid valves 12~16 are indicated for illustration only. They can be installed in different locations as desired. Further, as shown in FIG. 2, a receiver 56 and a remote controller 57 can be used instead of the operating unit 5 of the switches 51~54. The receiver 56 is installed in the furnace body 6, and connected to the electronic igniter 8 and the control unit 1 by conductors 75 and 76. The remote controller 57 is operated to give a signal to the receiver 56, causing it to turn on/off the electronic igniter 8 and to close/open the solenoid valves 12~16.

In one embodiment of the present invention, the control unit further comprises a temperature sensor. The detecting side (not shown) of the temperature sensor is installed in the area where the temperature is to be detected (either inside the furnace body 6 or outside the furnace body 6), and the contact side 55 of the temperature sensor is respectively connected to the switches 52~54. When the temperature inside the house surpassed the set value, the contact side 55 is opened to cut off power supply from the strong flame switch 52, the medium flame switch 53, or the weak flame switch 54, to further disenergized the high flow rate valve 14, the medium flow rate valve 15 or the low flow rate valve 16, causing the valve 14, 15 or 16 to be returned to the off status to stop fuel gas from passing to the main flame nozzle 64, so as to turn off the main flame (however, the mother flame is still maintained existed). When the main flame extinguished and the temperature inside the house dropped below the set value, the contact side 55 is closed to connect electricity to the strong flame switch 52, the medium flame switch 53, or the weak flame switch 54, to further energized the high flow rate valve 14, the medium flow rate valve 15 or the low flow rate valve 16, causing the valve 14, 15 or 16 to be opened for letting fuel gas to pass to the main flame nozzle 64 for burning by the mother flame at the mother flame nozzle 62.

Figure 8:
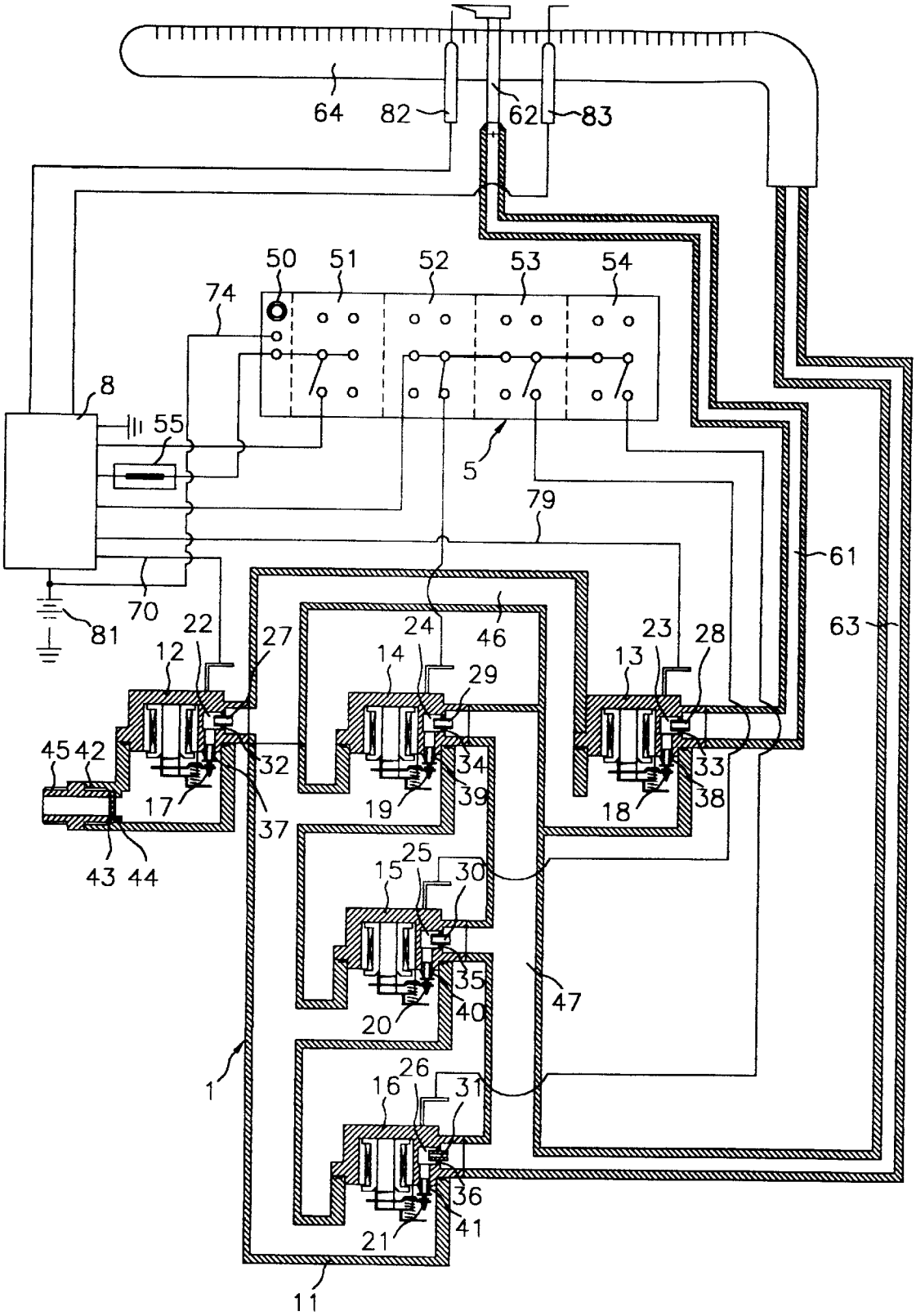
FIG. 8 illustrates the structure of a gas furnace control arrangement according to a third embodiment of the present invention.

Of course, the contact side 55 of the temperature sensor can be connected between the electronic igniter 8 and the power switch 51 (See FIG. 8). When the temperature inside the house surpassed the set value, the contact side 55 is opened to cut off power supply from the electronic igniter 8, causing the main flame and the mother flame to be extinguished at the same time. On the contrary, when the temperature inside the house dropped below the set value, the contact side 55 is closed to connect electricity to the electronic igniter 8, returning to the previous operation status.

In an alternate form of the present invention, the aforesaid high flow rate valve 14 is eliminated, the medium flow rate valve 15 and the low flow rate valve 16 are matched to substitute for the high flow rate valve 14. In order to fit this alternation, the strong flame switch 52 of the operating unit 5 is connected to the medium flow rate valve 15 and the low flow rate valve 16 by respective conductors 77 and 78, so that the medium flame switch 53 and the weak flame switch 54 are simultaneously switched on when switching on the strong flame switch 52 to open the medium flow rate valve 15 and the low flow rate valve 16, for enabling a strong volume of fuel gas to be delivered to the main flame nozzle 64.

In the aforesaid two embodiments, the conductor 79 controls the main valve 12 and the mother flame valve 13. In a third embodiment of the present invention as shown in FIG. 8, conductors 70 and 79 are installed to connect the main valve 12 and the mother flame valve 13 to the electronic igniter 8 respectively, enabling the electronic igniter 8 to control the main valve 12 and the mother flame valve 13 separately. In this case, the electronic igniter 8 has an added terminal for the connection of the conductor 70. Further, a control circuit is installed in the electronic igniter 8 to automatically cut off power supply from the mother flame valve 13 a few seconds after burning of the main flame, causing the cock 18 to be turned off to stop fuel gas from passing to the mother flame nozzle 62. This arrangement saves much power and fuel gas consumption.

Figure 9:
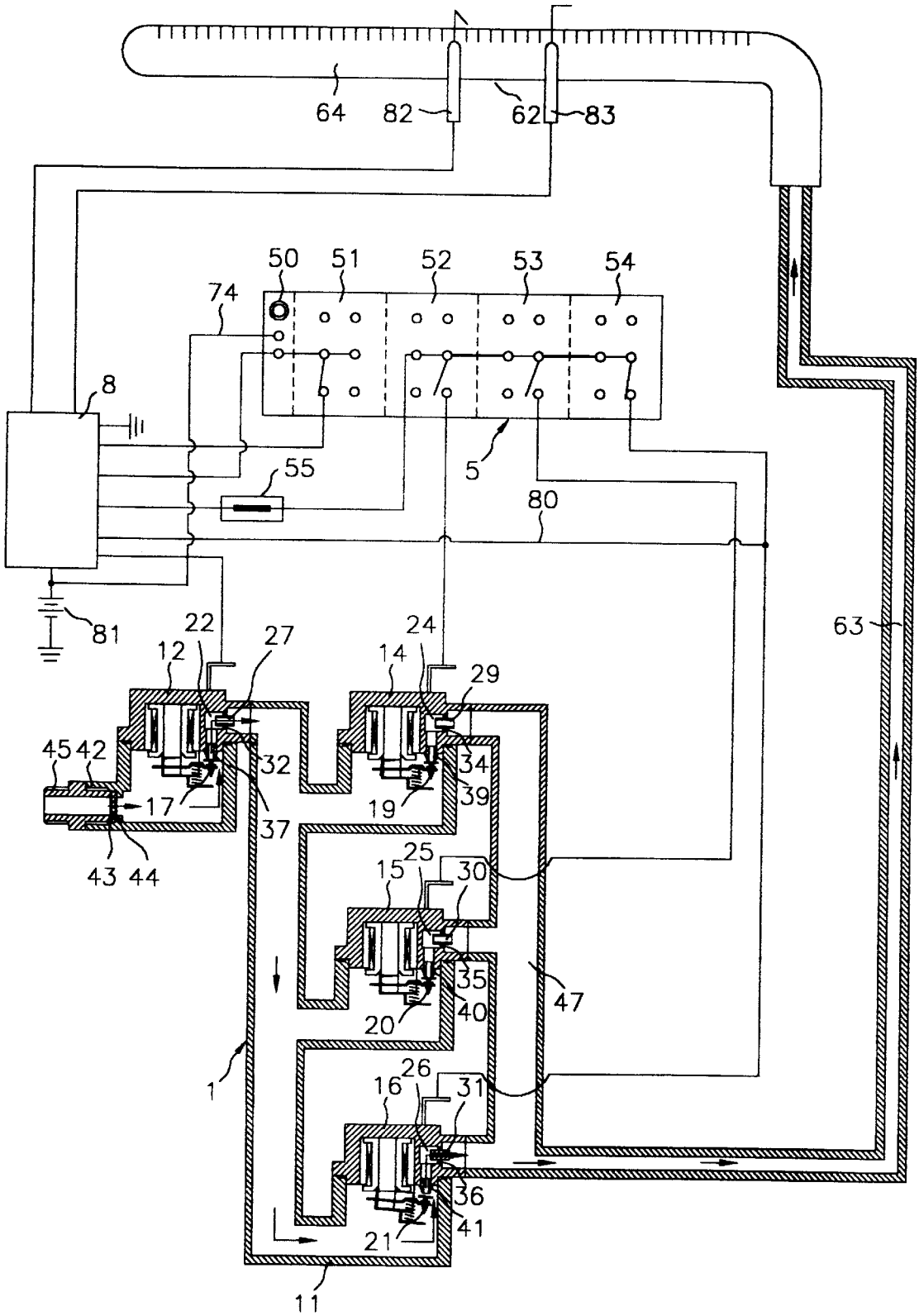
FIG. 9 illustrates the stricture of a gas furnace control arrangement according to a fourth embodiment of the present invention.

In a fourth embodiment of the present invention as shown in FIG. 9, the mother flame valve 13, the gas pipe 61 and the mother flame nozzle 62 of the first embodiment are eliminated, and the low flow rate valve 16 provides the function of the mother flame valve 13. According to this embodiment, a conductor 80 connects the low flow rate valve 16 to the electronic igniter 8 and the weak flame switch 54. After the power switch 51 has been switched on, the main valve 12 is opened to let a weak volume of fuel gas flow to the main flame nozzle 64 for burning by sparks discharged through the ignition plug 82 to provide the main flame. In this case, the volume of the furnace flame is still controlled by the strong flame switch 52, the medium flame switch 53, or the weak flame switch 54.

Figure 3A:
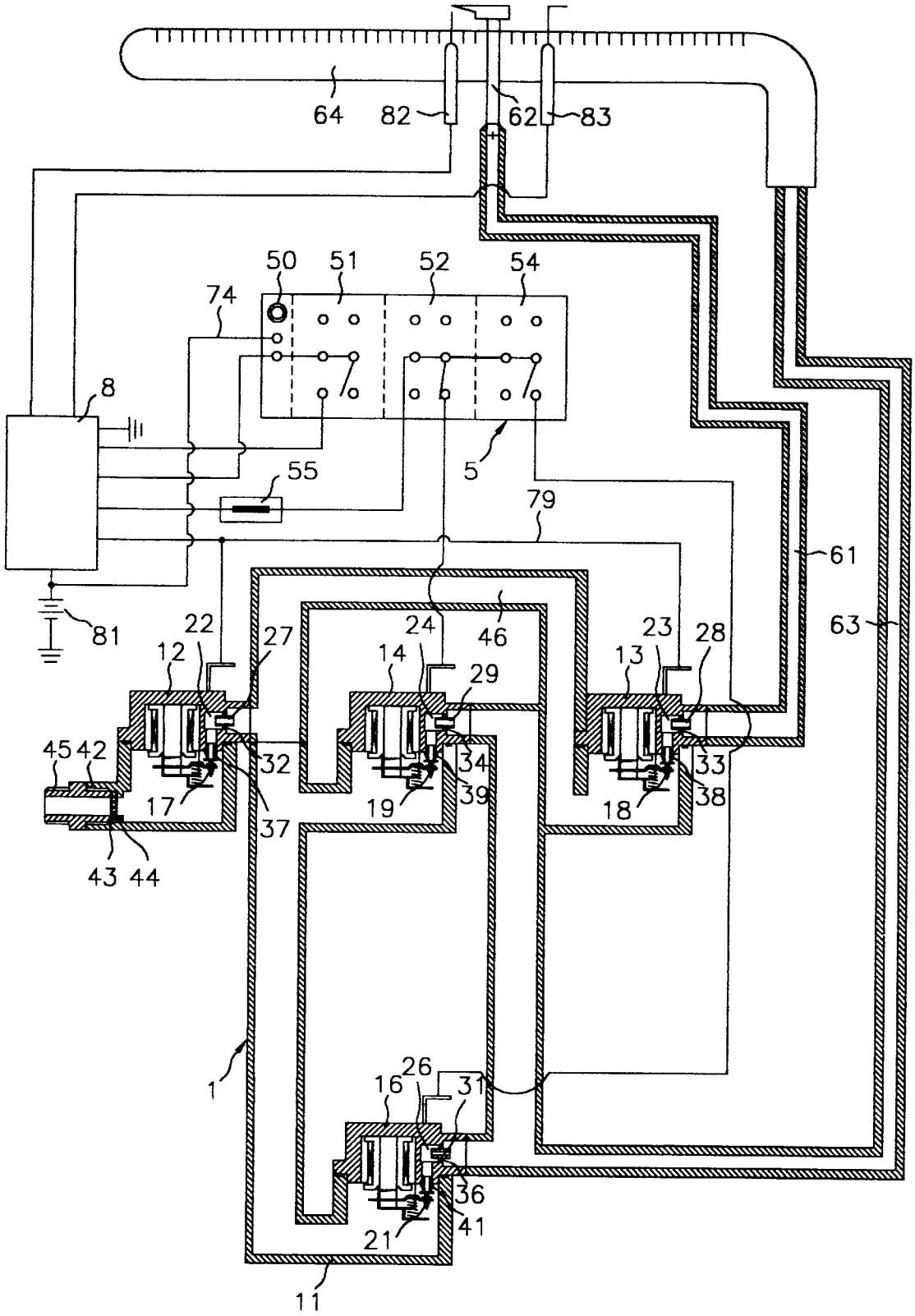
FIG. 3A is similar to the arrangement of FIG. 3 but the medium flow rate valve eliminated.
Figure 8A:
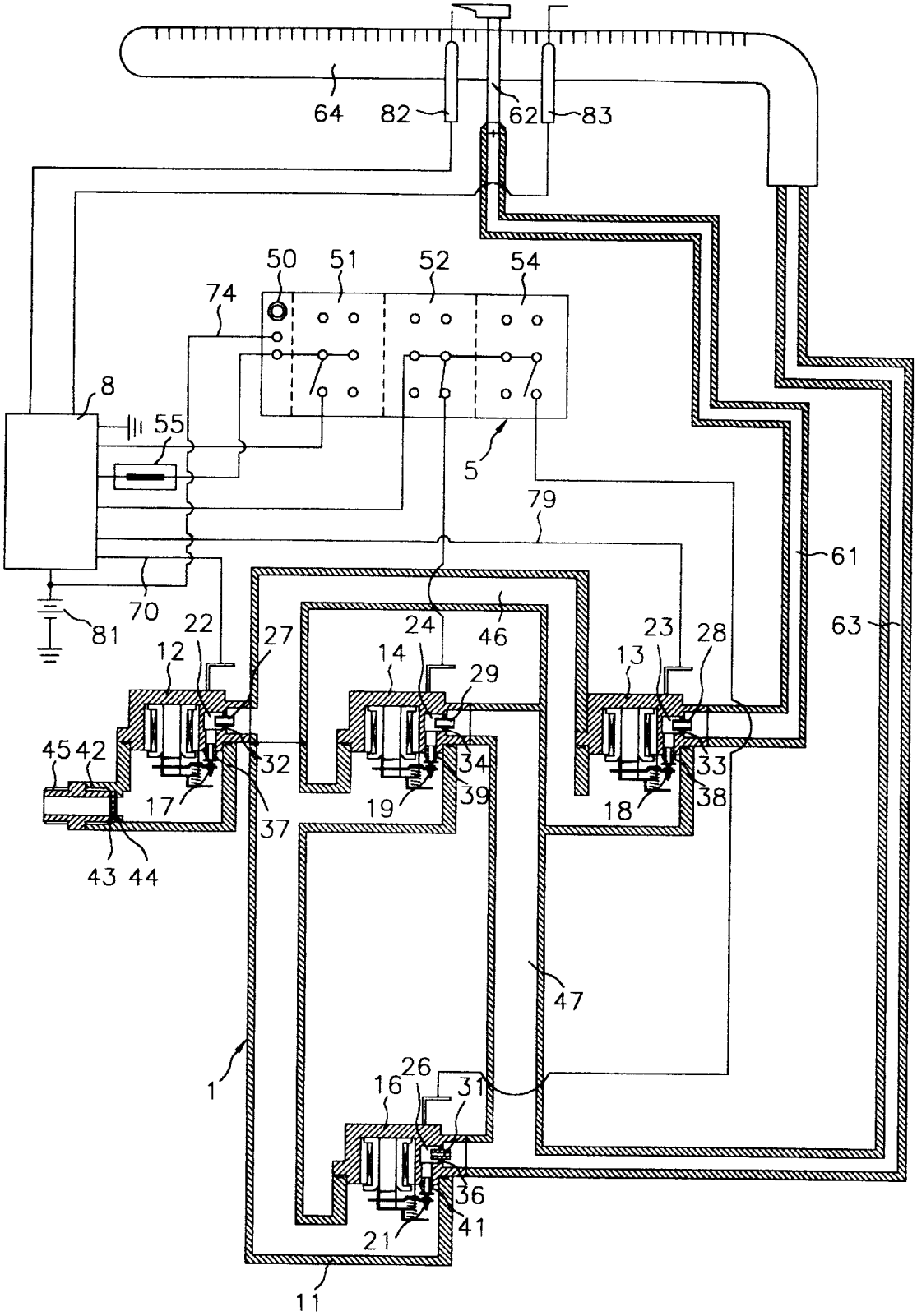
FIG. 8A is similar to the arrangement shown in FIG. 6 but the medium flow rate valve eliminated.
Figure 9A:
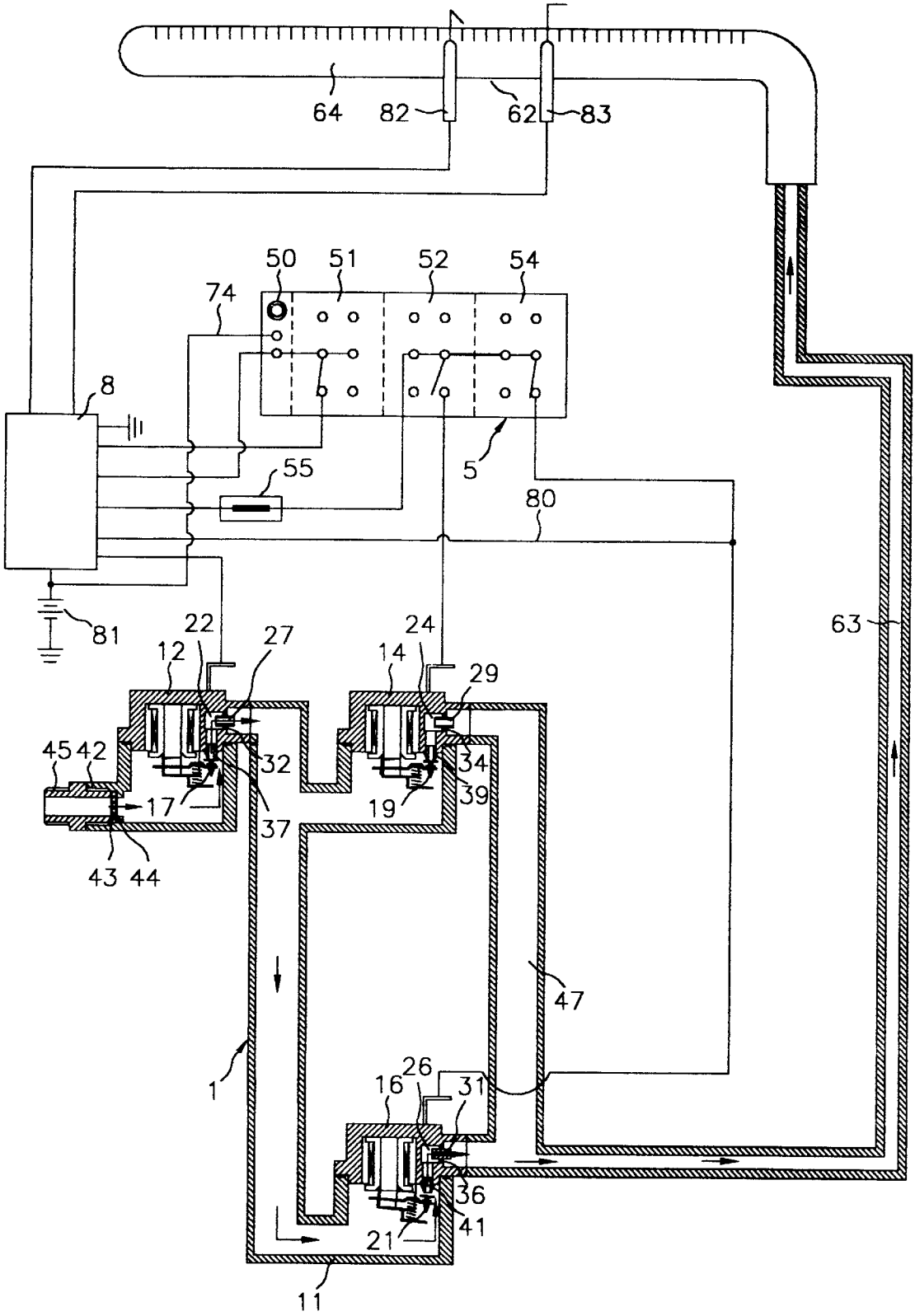
FIG. 9A is similar to the arrangement shown in FIG. 9 but the medium flow rate valve eliminated.

Further, the medium flow rate valve 15 of the first, third and fourth embodiments of the present invention may be eliminated, i.e., only the high flow rate valve 14 and the low flow rate valve 16 are provided for regulating the furnace flame between the strong furnace flame status and the weak furnace flame status. The respective alternate forms are shown in FIGS. 3A, 8A and 9A.

The second, third and fourth embodiments of the present invention are operated in the same manner as the operation of the first embodiment.

It is to be understood that the drawings are designed for purposes of illustration only, and are not intended for use as a definition of the limits and scope of the invention disclosed.

What the invention claimed is:

1. A furnace control arrangement comprising:

a control unit installed a furnace body having an electronic igniter and a mother flame nozzle and main flame nozzle, and said control unit being connected to the electronic igniter of said furnace body by conductor means, said control unit comprising a valve seat supported on said furnace body, and a set of solenoid valves mounted in said valve seat, said solenoid valves including a main valve adapted to control a gas passage from an external fuel gas source to said valve seat, a mother flame valve adapted to control a gas passage from said valve seat to said mother flame nozzle, a high flow rate valve adapted to control a big gas passage from said valve seat to said main flame nozzle, and a low flow rate valve adapted to control a small gas passage from said valve seat to said main flame nozzle; and an operating unit provided outside said furnace body and respectively connected to said control unit and said electronic igniter by respective conductor means, said operating unit comprising a power switch adapted to switch on/off said electronic igniter and to close/open said main valve and said mother flame valve, a strong flame switch adapted to close/open said high flow rate valve, and a weak flame switch linked to said strong flame switch and adapted to close/open said low flow rate valve.

2. The gas furnace control arrangement of claim 1, wherein said main valve and said mother flame valve are respectively connected to said electronic igniter by respective conductor means.

3. The gas furnace control arrangement of claim 1 further comprising a control circuit installed in said electronic igniter and adapted to cut off power supply from said mother flame valve a predetermined length of time after burning of discharged fuel gas at said main flame valve.

4. The gas furnace control arrangement of claim 1, wherein said operating unit further comprises a receiver installed in said furnace body and connected to said electronic igniter and said control unit by conductor means, and a remote controller adapted to control said receiver to switch on/off said electronic igniter and to close/open said solenoid valves.

5. The gas furnace control arrangement of claim 1 further comprising a temperature sensor, said temperature sensor comprising a detecting side installed in a predetermined location to detect the ambient temperature of said predetermined location, and a contact side connected to said electronic igniter and the linked switches of said operating unit.

6. The gas furnace control arrangement of claim 1 further comprising a temperature sensor, said temperature sensor comprising a detecting side installed in a predetermined location to detect the ambient temperature of said predetermined location, and a contact side connected between said electronic igniter and said power switch.

7. The gas furnace control arrangement of claim 1, wherein said operating unit comprises a power indicator light, and an indicator light control circuit connected between power source and said power indicator light.

8. The gas furnace control arrangement of claim 1, wherein said valve seat comprises a fuel gas inlet, said fuel gas inlet comprising a radial inside flange, a wire gauze filter mounted in said fuel gas inlet and supported on said radial inside flange, and a pipe connector fastened to said fuel gas inlet to hold down said wire gauze filter and connected to an external fuel gas source.

9. The gas furnace control arrangement of claim 1, wherein said control unit further comprises a normal-close medium flow rate valve, and said operating unit further comprises a normal-close medium flame switch linked to said strong flame switch and said weak flame switch and adapted to close/open said normal-close medium flow rate valve.

10. The gas furnace control arrangement of claim 9, wherein said main valve, said high flow rate valve and said mother flame valve each comprise a fuel gas outlet respectively mounted with a first gas tube peripherally sealed with an O-ring for output of fuel gas, said medium flow rate valve has a fuel gas outlet mounted with a second gas tube peripherally sealed with an O-ring for output of fuel gas, said second gas tube having an inner diameter smaller than said first gas tube; said low flow rate valve has a fuel gas outlet mounted with a third gas tube peripherally sealed with an O-ring for output of fuel gas, said third gas tube having an inner diameter smaller than said first gas tube and said second gas tube.

11. The gas furnace control arrangement of claim 9, wherein said main valve, said high flow rate valve and said mother flame valve each have a fuel gas inlet respectively mounted with a first gas tube for input of fuel gas, said medium flow rate valve has a fuel gas inlet mounted with a second gas tube for input of fuel gas, said second gas tube having an inner diameter smaller than said first gas tube; said low flow rate valve has a fuel gas inlet mounted with a third gas tube for input of fuel gas, said third gas tube having an inner diameter smaller than said first gas tube and said second gas tube.

12. A as furnace control arrangement comprising:

a control unit installed in a furnace body having an electronic igniter and a mother flame nozzle and a main flame nozzle, and said control unit being connected to the electronic igniter of said furnace body by conductor means, said control unit comprising a valve seat supported on said furnace body, and a set of solenoid valves mounted in said valve seat, said solenoid valves including a main valve adapted to control a gas passage from an external fuel gas source to said valve seat, a mother flame valve adapted to control a gas passage from said valve seat to said mother flame nozzle, a medium flow rate valve adapted to control a medium gas passage from said valve seat to said main flame nozzle, and a low flow rate valve adapted to control a small gas passage from said valve seat to said main flame nozzle; and an operating unit provided outside said furnace body and respectively connected to said control unit and said electronic igniter by respective conductor means, said operating unit comprising a power switch adapted to switch on/off said electronic igniter and to close/open said main valve and said mother flame valve, a strong flame switch adapted to close/open said medium flow rate valve and said low flow rate valve simultaneously, a medium flame switch linked to said strong flame switch and adapted to lose/open said medium flow rate valve, and a weak flame switch linked to said strong flame switch and said medium flame switch and adapted to close/open said low flow rate valve.

13. A gas furnace control arrangement comprising:

a control unit installed in a furnace body having an electronic igniter and a mother flame nozzle and a main flame nozzle, and said control unit being connected to the electronic igniter of said furnace body by conductor means, said control unit comprising a valve seat supported on said furnace body, and a set of solenoid valves mounted in said valve seat, said solenoid valves including a main valve adapted to control a gas passage from an external fuel gas source to said valve seat, a mother flame valve adapted to control a gas passage from said valve seat to said mother flame nozzle, a high flow rate valve adapted to control a big gas passage from said valve seat said main flame nozzle, a medium flow rate valve adapted to control a medium as passage from said valve seat to said main flame nozzle, and a low flow rate valve adapted to control a small gas passage from said valve seat to said main flame nozzle; and an operating unit provided outside said furnace body and respectively connected to said control unit and said electronic igniter by respective conductor means, said operating unit comprising a power switch adapted to switch on/off said electronic igniter and to close/open said main valve and said mother flame valve, a strong flame switch adapted to close/open said high flow rate valve, a medium flame switch linked to said strong flame switch and adapted to close/open said medium flow rate valve, and a weak flame switch linked to said strong flame switch and said medium flame switch and adapted to close/open said low flow rate valve.

* * * * *